US008371236B2

(12) United States Patent
Budnick

(10) Patent No.: US 8,371,236 B2
(45) Date of Patent: Feb. 12, 2013

(54) CONVERTIBLE STRUCTURE FOR RAIL CAR

(75) Inventor: Joseph C. Budnick, Omaha, NE (US)

(73) Assignee: Union Pacific Railroad Company, Omaha, NE (US)

( * ) Notice: Subject to any disclaimer, the term of this patent is extended or adjusted under 35 U.S.C. 154(b) by 231 days.

(21) Appl. No.: 12/846,306

(22) Filed: Jul. 29, 2010

(65) Prior Publication Data

US 2012/0024188 A1 Feb. 2, 2012

(51) Int. Cl.
*B61D 3/00* (2006.01)

(52) U.S. Cl. ..... 105/404

(58) Field of Classification Search ..... 105/238.1, 105/355, 375, 396, 404, 422, 425
See application file for complete search history.

(56) References Cited

U.S. PATENT DOCUMENTS

| | | | | |
|---|---|---|---|---|
| 3,996,860 | A | 12/1976 | Ravani et al. | |
| 4,318,349 | A | 3/1982 | Galasan | |
| 4,759,669 | A * | 7/1988 | Robertson et al. | 410/29 |
| 4,778,193 | A | 10/1988 | Torcomian | |
| 4,786,222 | A * | 11/1988 | Blodgett | 410/29 |
| 4,924,780 | A | 5/1990 | Hart | |
| 5,601,033 | A | 2/1997 | Ehrlich et al. | |
| 5,685,228 | A * | 11/1997 | Ehrlich et al. | 105/370 |
| 5,743,192 | A | 4/1998 | Saxton et al. | |
| 5,979,335 | A * | 11/1999 | Saxton et al. | 105/404 |
| 6,138,579 | A | 10/2000 | Khattab | |
| 6,551,039 | B1 | 4/2003 | Forbes | |
| 6,837,169 | B2 | 1/2005 | Michaelian et al. | |
| 7,360,979 | B2 | 4/2008 | Forbes | |
| 7,401,559 | B2 | 7/2008 | Dawson et al. | |
| 2008/0011187 | A1 * | 1/2008 | Halliar et al. | 105/396 |
| 2008/0022883 | A1 | 1/2008 | Schorr et al. | |
| 2008/0179020 | A1 | 7/2008 | Dawson et al. | |
| 2008/0276830 | A1 | 11/2008 | Dawson et al. | |

* cited by examiner

*Primary Examiner* — Robert McCarry, Jr.
(74) *Attorney, Agent, or Firm* — Pillsbury Winthrop Shaw Pittman LLP

(57) ABSTRACT

Disclosed is a rail car body having a roof, side walls, and a floor for supporting a series of vehicles in end to end relation longitudinally within the body so that they can be transported in a train. The rail car body includes an adjustable deck mounted within the body to support a second series of vehicles also in end to end relation. The adjustable deck has adjustable supports for vertically adjustment between at least two vertical positions in the body. The rail car body also includes a removable intermediate deck for supporting a third series of vehicles in end to end relation within the body. The removable intermediate deck is removably mounted on wheels (of a cart) and can be rolled longitudinally into and out of the rail car body. Thus, the rail car can be used in a two tier configuration or a three tier configuration.

16 Claims, 11 Drawing Sheets

CONVERTIBLE STRUCTURE FOR RAIL CAR

BACKGROUND

1. Field of Invention

The present invention is generally related to a convertible rack structure in a rail car. More specifically, an adjustable deck and a removable deck are used in the rail car.

2. Description of Related Art

Freight trains are often used to transport goods, including vehicles, such as compact cars and larger cars (e.g., SUVs). Known solutions for transporting such vehicles are limited. The number of vehicles that can be transported in a rail car at one time is also limited to the size of the car and the number of racks or decks provided inside the rail car. Typically, these racks or decks are permanently mounted or secured inside the car. In some cases, the size of the car (e.g., SUV versus a compact car) limits the type of rail car or rack that could be used for transportation. Designs with two decks are only able to carry a limited number of compact vehicles. Larger cars such as SUVs may also be transported using two deck designs, because of the larger amount of vertical space provided by the two levels, for example. However, in today's environment, the demand for bi-level racks or decks for loading finished vehicles is low because of their limitations (e.g., the limited number of vehicles that can be transported in one rail car). Therefore, bi-level rail cars are sometimes stored and other equipment (such as flatcars) may be rented. The lack of demand for loading bi-level cars generates greater costs for a company, as not using such equipment can be wasteful, and costs for storing such equipment can be unforeseen and/or expensive.

Alternatively, multi-level or three (3) deck designs have also been developed in order to attempt to solve the problem of transporting passenger vehicles and/or larger numbers of vehicles in a rail car. However, older versions of multi-level may fail to offer flexibility or adjustability. Some more recent designs may allow for adjustment of deck structures, i.e., adjusting an elevation of first and second decks within an auto car, including bringing the decks together to create a "bi-level" configuration for taller vehicles, and moving them apart to create a "tri-level" configuration for shorter vehicles. For example, U.S. Pat. Nos. 5,685,228, 5,743,192, 5,979,335 and 6,138,579, all of which are hereby incorporated by reference in their entirety, illustrate examples of current multi-level deck systems in rail cars. Another known multi-level rail car is a design by Greenbrier AutoMax. The Greenbrier AutoMax design has upper and lower decks that are used to provide three levels for transporting cars. In a similar manner as noted above, the upper and lower decks may be lowered and/or raised to reposition the decks to different levels. Although such designs as the AutoMax design or any of the incorporated patents may allow for movability or adjustability of the decks to alter their interior configuration, such designs generally significantly increase the size of the overall rail car, in at least its length and height. It can also increase the weight of the car. These large designs can cause problems along the railroad. For example, AutoMax's larger cars are non-universal and may be prohibited from travel because they are restricted to clearance corridors that must exceed 20 ft, 2 in height and their travel must be approved by operators of the railroads. Thus, the AutoMax cars may be limited from travel within tunnels and other areas along the railroad.

The designs shown by AutoMax and the incorporated patents are also limited because a deck cannot be removed from the interior structure of the rail car (unless it is cut up into destroyed pieces from the inside). Also, existing designs are generally not capable of interchanging with existing freight car equipment.

Railroads would benefit from a rail car that is capable of holding an increased number of vehicles for transportation. Also, a multi-level structure that is convertible from a two deck to a three deck design (and vice versa) would allow for flexibility in transporting goods without increasing overall costs for buying multiple types of rail cars (i.e., buying both 2 deck rail cars and 3 deck rail cars) and/or storing cars not in use.

SUMMARY

One aspect of the invention provides a rail car for transporting vehicles having: a rail car body having a roof, side walls, and a floor for supporting a series of vehicles in end to end relation longitudinally within the rail car body. The rail car also has track engaging wheels for rollingly supporting the rail car body on a pair of rail tracks, an adjustable deck, and a removable intermediate deck. The adjustable deck is adjustably mounted within the rail car body for supporting a second series of vehicles in end to end relation longitudinally within the rail car body. Adjustable supports are provided on opposing lateral sides of the adjustable deck for vertically adjusting a position of the adjustable deck within the rail car body, and the adjustable deck is vertically movable by the adjustable supports between at least higher, first and lower second positions spaced above the floor and below the roof. The removable intermediate deck supports a third series of vehicles in end to end relation longitudinally within the rail car body. The removable intermediate deck is configured for movement longitudinally into and out of the rail car body for installation and removal of the removable intermediate deck with respect to the rail car body. The removability of the removable intermediate deck enables the rail car to be used in (a) a two tier configuration with the removable intermediate deck removed and the adjustable deck in the lower second position for transporting the first and second series of vehicles and (b) a three tier configuration with the removable intermediate deck in the rail car body and the adjustable deck in the higher first position for transporting the first, second, and third series of vehicles.

Another aspect of the invention provides a removable deck for supporting a series of vehicles in end to end relation longitudinally within a rail car body. The rail car body has a roof, side walls, and a floor for supporting a series of vehicles in end to end relation longitudinally within the rail car body. The removable deck has a longitudinally extending structure with a surface for supporting the series of vehicles, and locking mechanisms on opposing lateral sides of the structure for securing a position of the structure within the rail car body. The position for securement of the removable deck is spaced above the floor and below the roof of the rail car body. The securement of the removable deck in the rail car body enables transportation of at least a second series of vehicles.

In another aspect of the invention, a train is provided having: a locomotive comprising a body and track engaging wheels, and at least one rail car for transporting vehicles. The at least one rail car includes: a rail car body having a roof, side walls, and a floor for supporting a first series of vehicles in end to end relation longitudinally within the rail car body; track engaging wheels for rollingly supporting the rail car body on a pair of rail tracks; an adjustable deck adjustably mounted within the rail car body for supporting a second series of vehicles in end to end relation longitudinally within the rail car body; adjustable supports on opposing lateral sides of the adjustable deck for vertically adjusting a position of the adjustable deck within the rail car body, the adjustable deck being vertically movable by the adjustable supports between at least a higher, first position and a lower second position each spaced above the floor and below the roof; and a removable intermediate deck for supporting a third series of vehicles in end to end relation longitudinally within the rail car body, the removable intermediate deck configured for movement longitudinally into and out of the rail car body for installation and removal of the removable intermediate deck with respect to the rail car body. The removability of the removable intermediate deck enables the rail car to be used in (a) a two tier configuration with the removable intermediate deck removed and the adjustable deck in the lower second position for transporting the first and second series of vehicles and (b) a three tier configuration with the removable intermediate deck in the rail car body and the adjustable deck in the higher first position for transporting the first, second, and third series of vehicles.

Other objects, features, and advantages of the present invention will become apparent from the following detailed description, the accompanying drawings, and the appended claims.

DETAILED DESCRIPTION OF THE PREFERRED EMBODIMENT(S)

The herein described rack structure for a rail car is designed to be convertible from a three tier configuration (tri-level) to a two tier configuration (bi-level), and/or the reverse. Included is a removable intermediate structure which is designed to be selectively installed into and removed from out of an interior of structure and saved as a useable deck for future three tier requirements. An adjustable deck is moved (lowered) for a two tier setting, thus making a rack transformation from tri (3) to bi (2) levels. The herein disclosed design also incorporates rail tracks on a floor or a bottom deck structure, in which a rail cart may roll on and/or within, to assist in moving (removing or inserting) the removable intermediate structure into and out of the rack structure. Further details regarding these and other features are described below.

Figure 1:
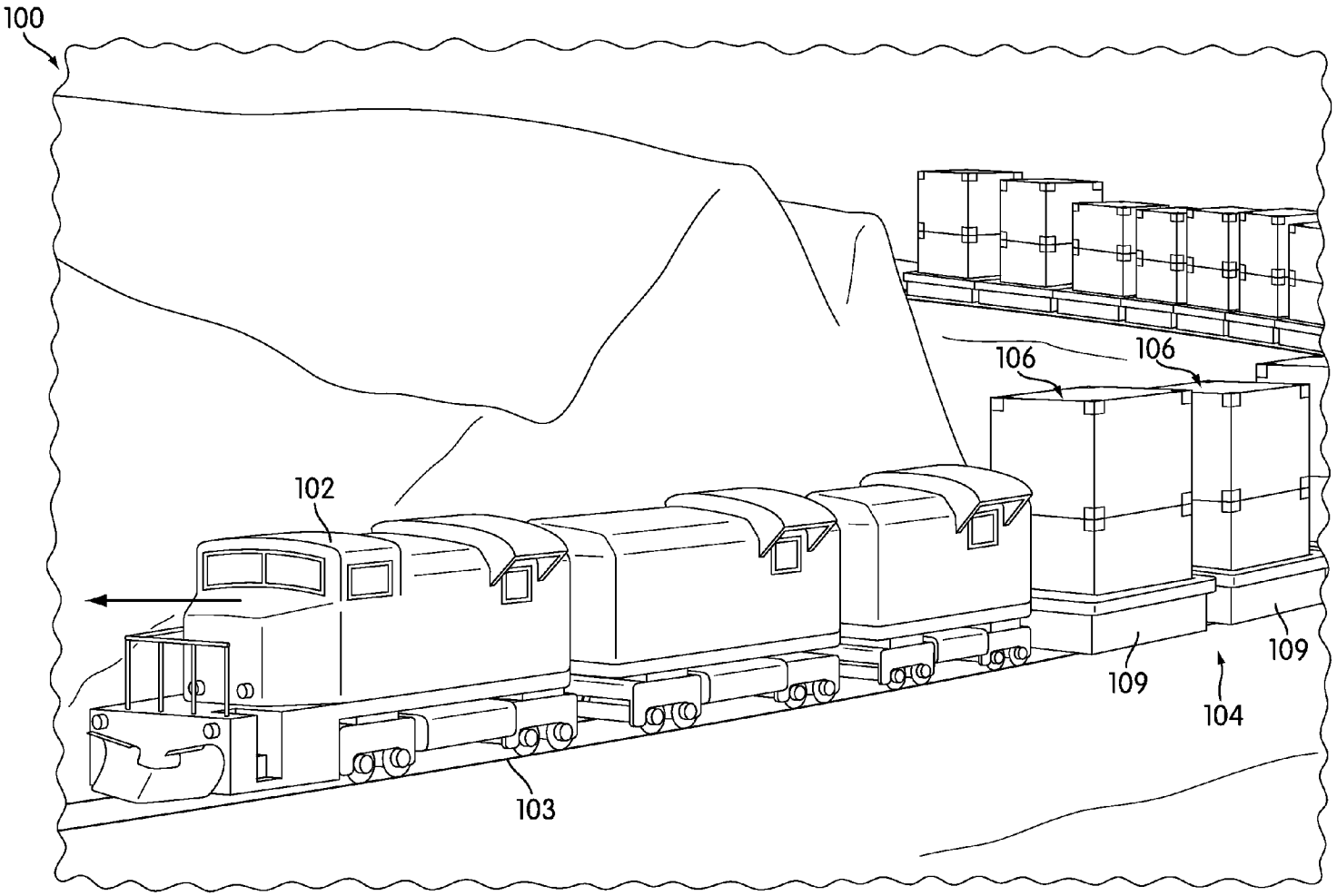
FIG. 1 illustrates a freight train pulling cars along tracks.

FIG. 1 shows a freight train 100 pulling cars along tracks 103. The freight train 100 generally comprises at least one leading locomotive 102 at a front end of the train for pulling a series 104 of containers 106 in freight cars 109 on railroad tracks or rails 103. A "locomotive" refers to a device which assists in moving cars in a train. A "car" may be generally referred to as a body with track engaging wheels and couplings that is connected in a train 100 for transporting items. A car 109 may carry one or more containers 106 thereon. Generally such devices are known in the art and thus are not described in detail. For example, containers 106 may be provided in single or stacked form on a surface of a flat car, or within a well of a well car. The type and/or number of cars provided within a length of train 100 should not be limited. Furthermore, the number and/or types of containers 106 should not be limited. In an embodiment, containers 106 need not be provided in train 100.

In some cases, freight train 100 is used to transport goods, cargo, and other items that are of higher weight. As noted above, vehicles (such as automobiles, trucks, SUVs) 200 may be transported by freight trains. One or more of the cars 109 may be configured to transport loads such as vehicles 200. To transport vehicles and/or other cargo, it is to be understood that in some embodiments the leading locomotive 102 may comprise a locomotive consist, comprising a collection of two or more locomotives connected to each other in a series. For example, two or three locomotives may be provided at the front of the train 100 to lead the cars along the tracks 103. Additionally and/or alternatively, one or more locomotives may be provided within the length of the train 100 (e.g., halfway through) to assist in moving cars 109 along the track. In some cases, the placement of one or more locomotives 102 or locomotive consists may be based upon the weight of the cargo or items being transported. Each locomotive 102 comprises a body and track engaging wheels for moving cars 109. The locomotive(s) 102 also comprise a power system for driving the track engaging wheels of the locomotive(s) 102 to move the locomotive(s) and the cars 109 along the tracks 103. The power system may be of any type, including but not limited to a diesel engine, an AC or DC generator powered by a diesel engine, a fuel cell, a battery, a flow battery, or any other system for providing locomotive power. Generally such configurations are known in the art and therefore are not discussed in further detail herein. The number of locomotives in the train 100, however, should not be limiting.

Figure 2:
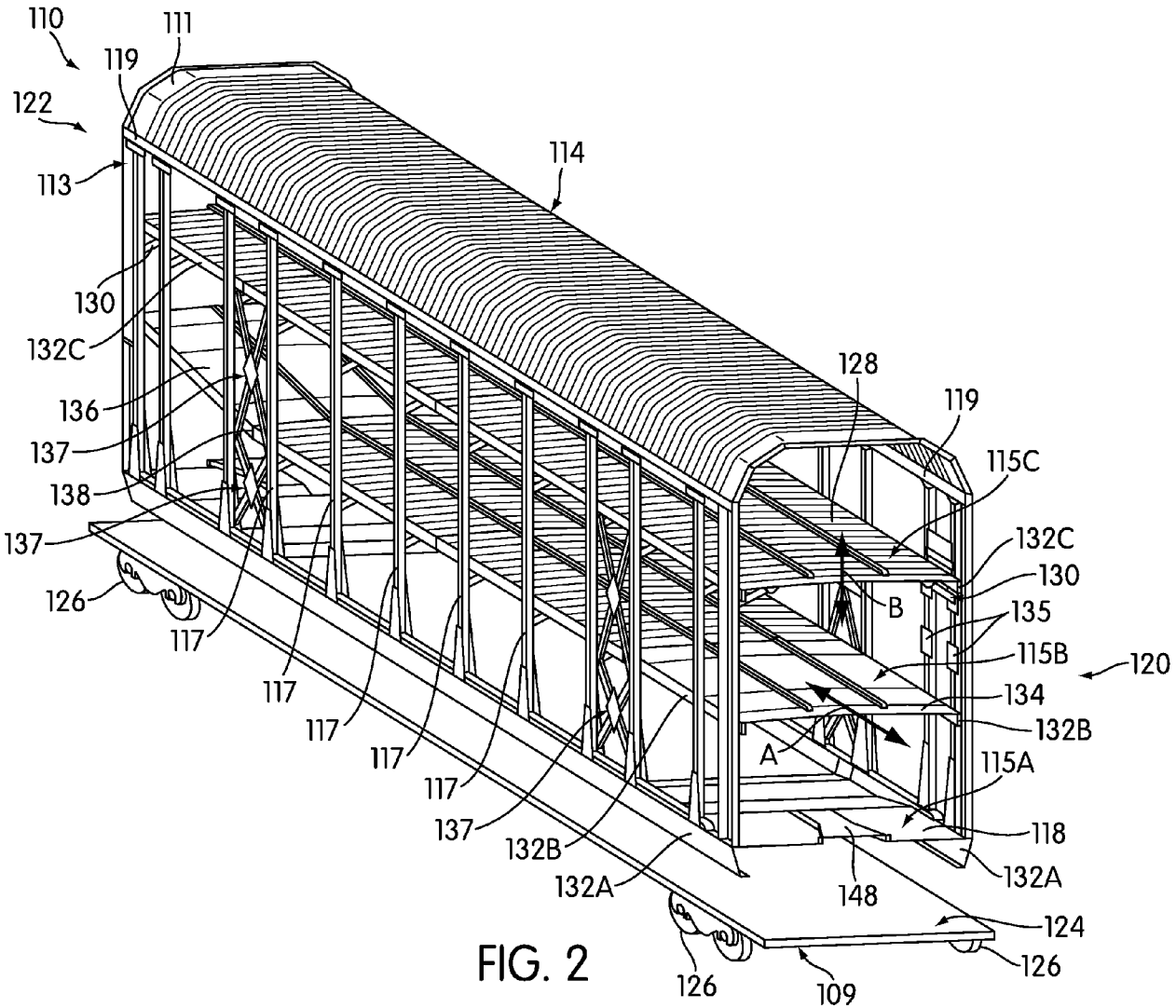
FIGS. 2, 3, and 4 illustrate a perspective view, a side view, and an end view, respectively, of a rail car for transporting vehicles in a tri-level or three tier configuration in accordance with an embodiment of the present invention.
Figure 3:
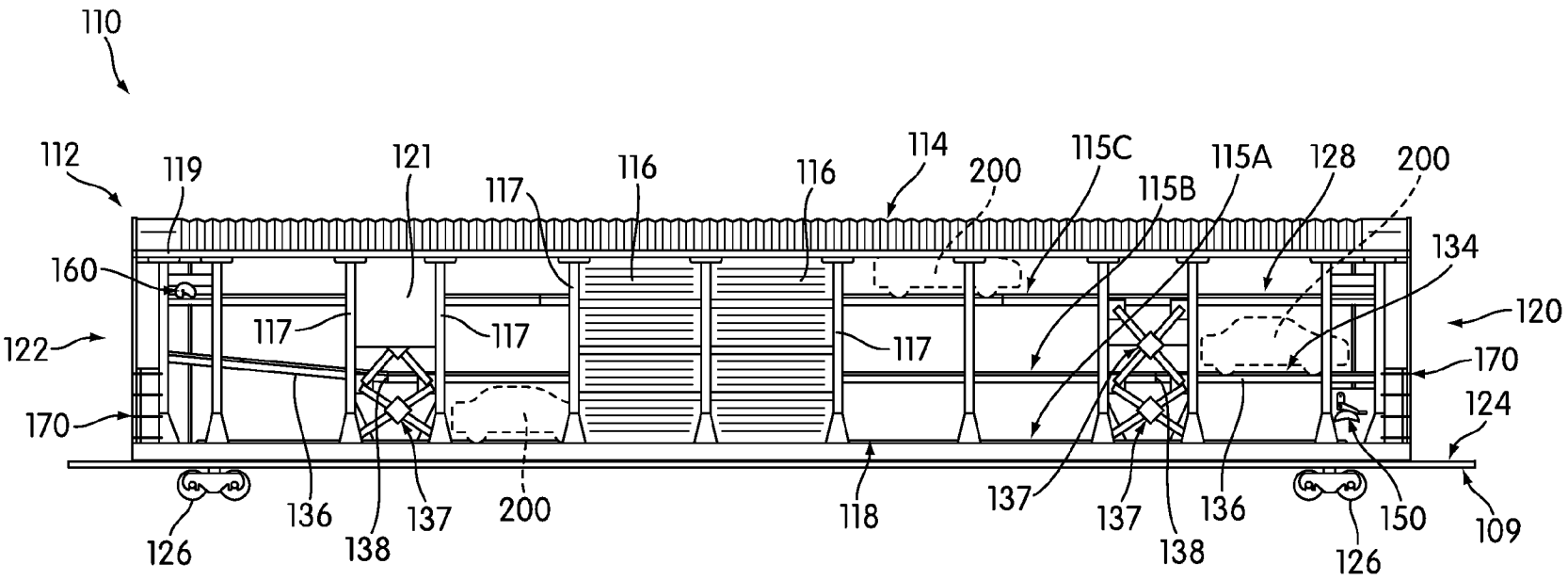
Figure 4:
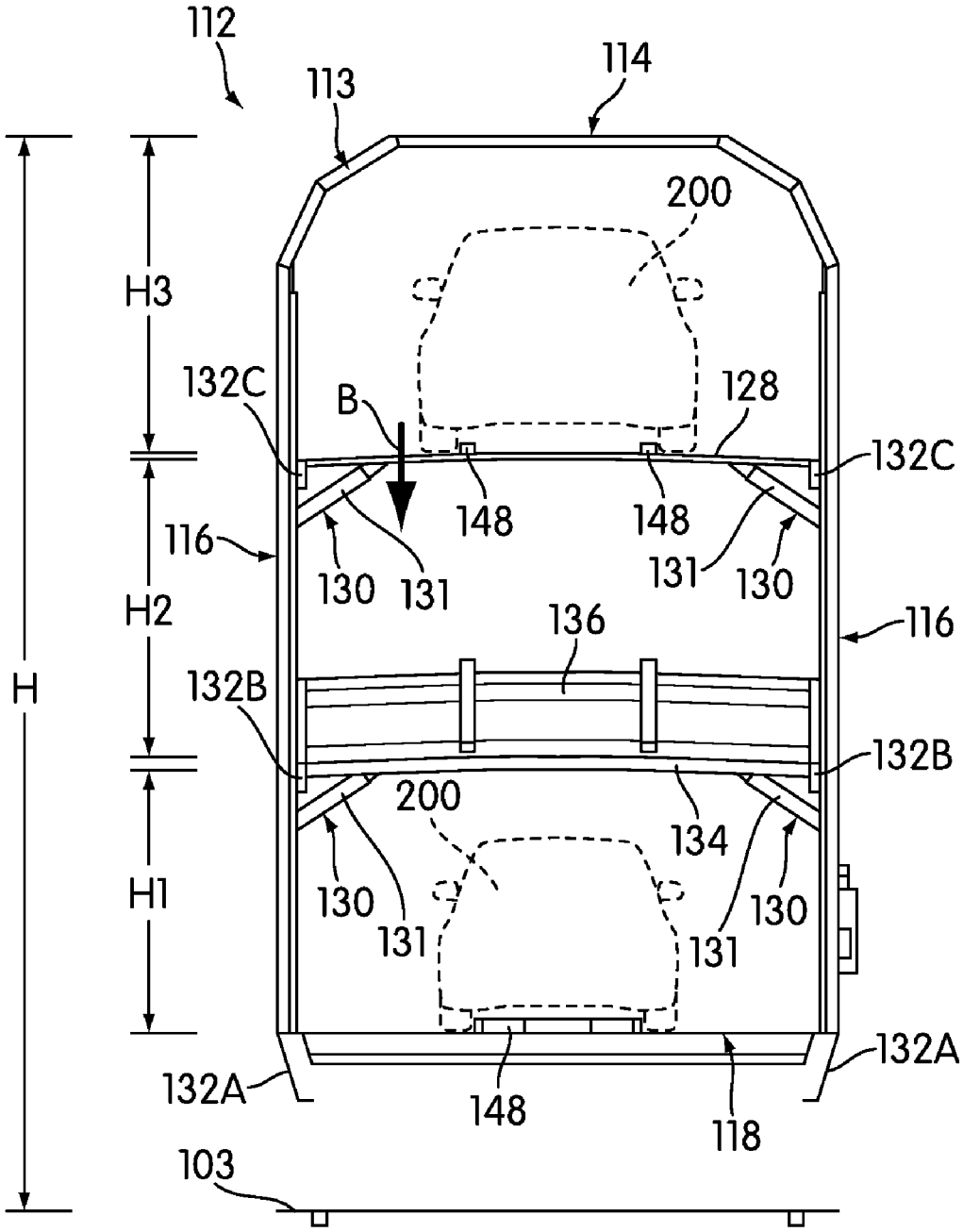

FIGS. 2, 3, and 4 illustrate a perspective view, a side view, and an end view, respectively, of an exemplary rail car 110 for transporting a load including vehicles by train, such as train 100, with a tri-level or three tier configuration. Rail car 110 may be connected to similar cars 110, cars 109, and/or other transporting units in train 100. In this embodiment, the rail car 110 comprises a body 112 with a multi-level convertible rack framing structure 113 mounted to car 109. In the illustrated embodiment, the car 109 is a flat car with a surface 124 for receiving and attaching to the rail car body 112/structure 113 thereto. For example, a 90 ft. length flatcar may be utilized. The structure 113 may be permanently or removably attached and/or mounted to the flat car surface 124 to form a unit herein referred to as a "rail car." However, it is to be understood that the flat car or car 109 need not be provided as a part of the disclosed design, and that the structure 113 and flat car may be separate structures. Alternatively, it is also envisioned that the structure 113 may be formed with features similar to the flat car 109 (e.g. wheels, couplings, etc.) that enables its use solely as a rail car (i.e., without mounting to another, separately existing structure).

The multi-level design of rail car 110 provides the flexibility to convert between a two tier configuration (e.g., to hold two levels of vehicles) (e.g., see FIGS. 5-8) and a three tier configuration (e.g., to hold three levels of vehicles) (e.g., see FIGS. 2-4). In an embodiment, the multi-level convertible structure 113 of body 112 is designed to be convertible between two tier and three tier configurations, in which the desired mode complies with all requirements or standards of the Association of American Railroads (AAR) Manual of Standard and Recommended Practices, provided by Specifications M-950-99 ("Universal Wide-Body Tri-Level Fully Enclosed Autorack Car (Low Deck)") or M-950-A-99 ("Universal Wide-Body Bi-Level Fully Enclosed Autorack Car (Standard Deck)").

Referring back to the illustrated embodiment of FIGS. 2-4, rail car 110 is shown in a three tier configuration and includes a rail car body 112 having a roof 114, side walls 116 (e.g., shown in FIG. 3), and a floor 118. As noted above, the body 112 comprises structure 113 which comprises a plurality of vertical column posts 117 that are longitudinally spaced between first end 120 and second end 122 of the rail car 110. The posts 117 are provided on a first (left) side and a second (right) side of the body 112. The posts 117 may be connected to a top or sides of the floor 118 using end connections and/or other devices as is generally known in the art (e.g., connection plates or tubes secured by bolts, welding, etc.). The posts 117 may also be connected or secured at a top end by one or more longitudinal supports 119 or chords. Each longitudinal support 119 generally extends the length of the structure in a longitudinal direction. End caps, connection plates, braces, bolts, rivets, welding, etc. may be used to secure the posts 117 of the structure 113 and are not discussed in detail herein. Longitudinal and/or lateral supports (e.g., side sill members) similar to supports 119 may be provided on, attached to, or adjacent floor 118 and may also be used for securing posts 117 and other parts of structure 113. Additionally, side braces 137 may be provided between posts 117 any number of locations to strengthen the structure 113, for example. Side braces 137 may be formed from cross braces welded to a connection plate, for example. One or more of the posts 117 and/or supports 119 may be positioned to form the structure 113 per standard locations as provided in the AAR M-950-99 requirements. The structure 113 may comprise any number of materials and should not be limiting. For example, in an embodiment, the vertical column posts 117 and longitudinal supports 119 comprise steel tubes.

The roof 114 is attached at a top of structure 113 using attachment devices and/or methods as generally known in the art (e.g., bolts, welding, etc.). Although not shown, a plurality of longitudinally and laterally extending supports or chords may be provided adjacent or under roof 114. For example, additional longitudinal supports may be provided between first (left) and second (right) sides, extending from first end 120 to second end 122. Lateral supports (not shown) may be connected to additional longitudinal supports (not shown), and in some cases may extend from the first side to the second side. The lateral supports may be connected at their ends to the longitudinal supports 119. The lateral supports may comprise any number of shapes, including, but not limited to, an arch-like shape. In an embodiment, the roof 114 is secured (e.g., welded, bolted) to the longitudinal supports 119 (and those not shown) and/or the lateral supports extending the length of the rail car body 112. The roof 114 may comprise one or more sheets that are formed or pre-fabricated from any number of materials (e.g., steel). The sheets of the roof 114 may meet requirements of AAR M-950-99 for universality standards on interchange clearances and part reparability. In an embodiment, each end 120 and 122 of the rail car body 112 has a canopy 111 which the roof 114 may be secured to (later described with respect to FIG. 6).

The side walls 116 (see FIG. 3) may comprise screen panels that may be attached to at least one or more of the vertical column posts 117 of the structure 113 using known attachment devices or methods (e.g., welding). The side walls 116 or screens may be built to meet all dimensional requirements (e.g., inside length, inside width, between side posts and between panels) for rack structures, and meet or exceed requirements in accordance with AAR standard M-950-99. The formation and materials used to form and attach the side walls and should not be limiting. For example, the side walls 116 may be formed from a plurality of welded sheet metal panels. In addition or alternative to screen panels, one or more panels 121 with as a decal may be mounted between or on the vertical column posts 117.

Also, other known devices used with rail cars may be provided on rail car 110 and/or its structure 113. For example, as shown in greater detail in FIG. 6, one or more ladders 170 may be provided on rail car 110. Ladders 170 may be provided at either or both ends 120 and/or 122 on a side or adjacent a side of end canopy 111 on of car 110, for example. Ladders 170 may comprise any number of rungs and be attached to posts 117. Ladders 170 may provide access to the decks of car 110, a pulley system 160 for moving such decks (further noted below), and/or other parts of the rail car 110, for example.

Additionally, other devices may be provided with respect to the structure 113 that are not specifically shown in the figures. For example, in an embodiment, connecting anti-barrier panels are attached to side walls 116 or screens. Anti-barrier panels connect the side walls to each other (side screen to side screen) in the bays between the column posts 117. These anti-barrier panels may provide for the strength requirements to withstand forces thereon (e.g., of up to approximately 1000 pounds) and to provide the security to multi-level structure 113, so as to prevent entry or violations by those who are unauthorized to access contents in car 110.

The floor 118 is one of the deck structures of the rail car 110 and is configured to support a load such as a series of vehicles 200 in end to end relation longitudinally within the rail car body 112 (i.e., between ends 120 and 122). The floor 118 is sometimes referred to as an "A deck" or "first deck" throughout this disclosure. The floor 118 comprises a longitudinally extending surface 115A that is designed to receive the vehicles 200 thereon. The floor 118 may be flanked by two lateral sides 132A when attached to car 109. Although throughout the Figures the lateral sides 132A are shown as attached to floor 118, it should be understood by those in the art that sides 132A may be a part of car 109 and need not be provided as a part of the body 112 or structure 113 as disclosed herein. The sides 132A are shown attached to the floor 118 for illustrative purposes only and should not be limiting. For example, lateral sides 132A may be supports attached to flat car 109 and to a part of structure 113 (in this illustrated example, the floor 118) for securement purposes. Each side 132A may be attached to one or more of the vertical column posts 117 and/or the surface 124 of the car 109. The floor 118 may have couplings, castings, guides, locking devices, and other known features at either end 120 and 122 which may assist in transport of the rail car 110 (e.g., using train yard equipment such as a crane) or attachment within a train 100. For example, a tie-down system, such as plastic chocks, for securement of vehicles being shipped may be provided adjacent to or on floor 118. In another embodiment, attachment devices may be provided in alternate positions on structure 113. Such systems are generally known in the art and may be a purchased item. For example, Standard Car Truck Company® (SCT), Wabtec Corporation, Holland Company, Holden America, Inc., and ZefTek, Inc., each have tie down or locking systems that may be used with body 112, such as by being attached on or adjacent floor 118, as well as to the below-described decks 128 and 134, to secure vehicles thereon and/or therein.

Figure 5:
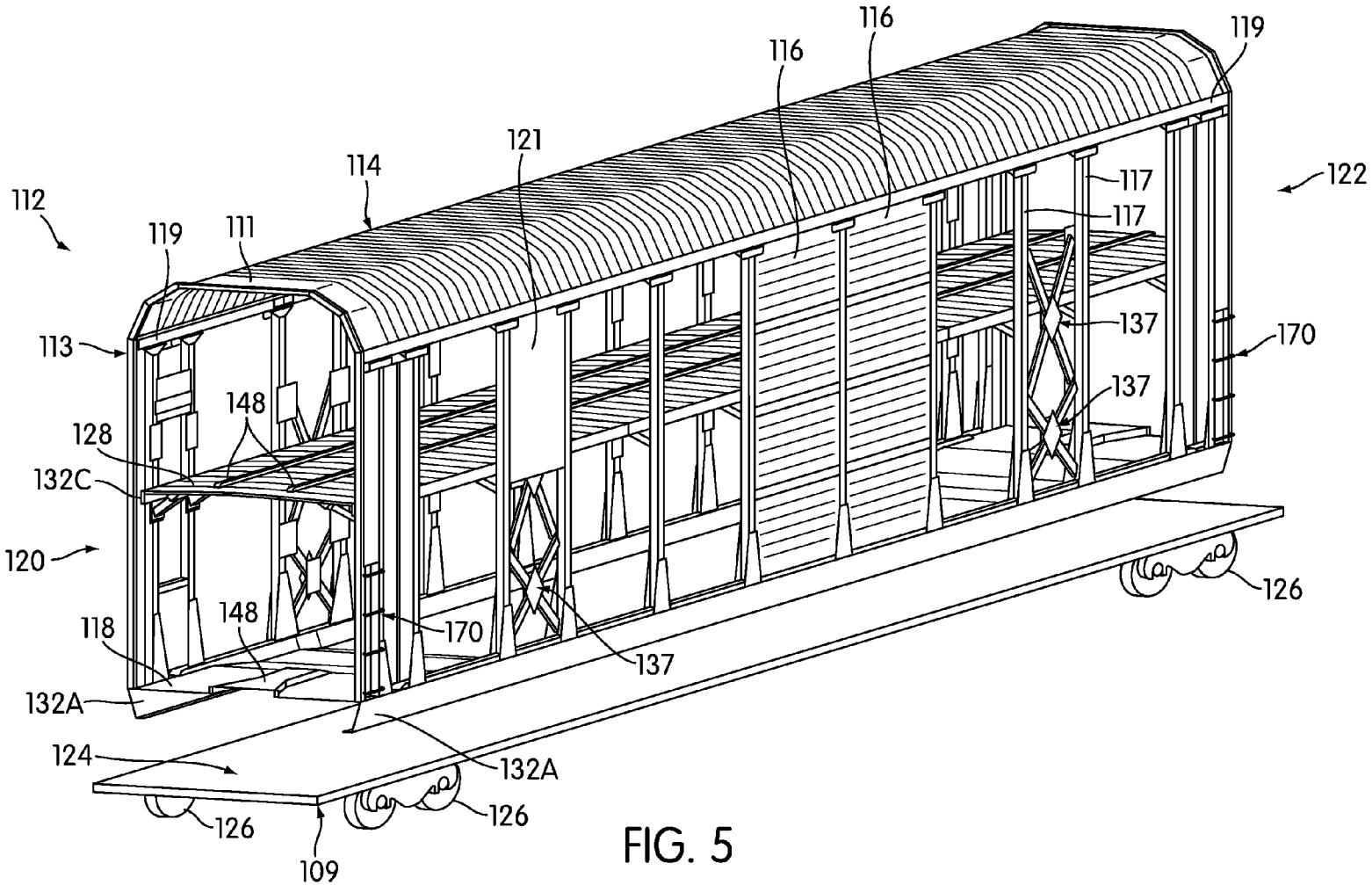
FIGS. 5, 6, 7, and 8 illustrate a perspective view, a detailed perspective view, a side view, and an end view, respectively, of a rail car for transporting vehicles in a bi-level or two tier configuration in accordance with an embodiment of the present invention.
Figure 8:
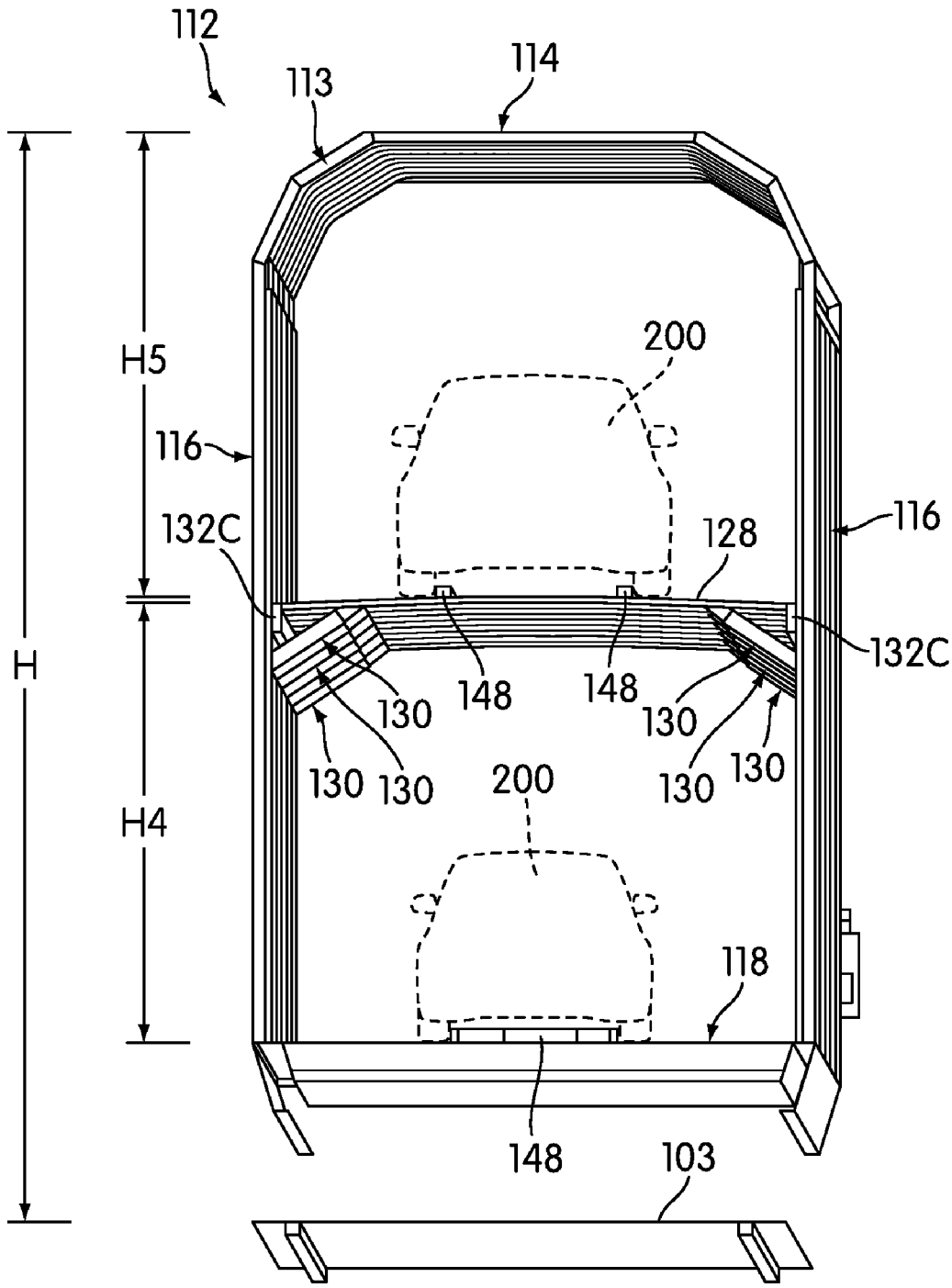

Although floor 118 may comprise a generally flat surface, in an embodiment, the surface 115A of floor 118 may also comprise tire guides 148 that are attached or formed (e.g., stamped) onto its surface. In an embodiment, as shown in FIGS. 2 and 5, for example, at one or more of its ends 120 and/or 122, tire guides 148 may be provided to direct vehicles into the structure 113 as they are moved into the floor 118. In another embodiment, as generally shown in FIGS. 4 and 8, tire guides 148 may be provided on one or more decks (floor 118, adjustable deck 128 and/or removable intermediate deck 134) and positioned to generally extend a length of the entire corresponding surface. The tire guides 148 may comprise a single longitudinal structure (e.g., with tires of vehicles guided longitudinally into the structure 113 on either side) or may comprise a pair of parallel structures extending the structure's length. For example, in an embodiment there may be parallel guides positioned on the surface 115A. Such tire guides 148 may serve to guide vehicle wheels while loading vehicles into the rail car 110 (e.g., in a straight path). In an embodiment, one or more locking devices may be associated with the tire guides 148 and/or decks to lock the wheels or vehicles thereto once they are loaded therein (e.g., so that they do not move during transportation).

Rail car 110 comprises track engaging wheels 126 for rollingly supporting the rail car body 112 on a pair of rail tracks 103. In an embodiment, wheels 126 may be attached to an underside of the floor 118. In the illustrated embodiment, the wheels 126 are provided on the flat car 109. Also, a handbrake mechanism assembly 150 may be provided on car 109 and/or body 112 in accordance with an embodiment. Handbrake mechanism assembly 150 is a known device that may be provided to manually apply brakes to wheels 126 of car 109 (like a parking brake). For illustrative purposes only, handbrake mechanism assembly 150 is shown provided adjacent or at end 122 in FIG. 3 on car 109, but may also be provided adjacent or at end 120 (i.e., it may be moved and/or a second handbrake assembly may be provided). Such handbrake assemblies are generally known in the art. The handbrake mechanism assembly may be part of a pre-fabricated flat car or attached thereto. The handbrake mechanism assembly may be a vertical or horizontal braking device. Ellcon-National Inc., Universal Railway Devices Co., Klasing Hand Brake Co., and W. H. Miner Inc. are examples of companies which provide and/or manufacture handbrake assemblies that may be used with the herein described rail car 110, but should not be limiting.

Referring back to FIG. 2, in another embodiment, it is envisioned that the floor 118 of the rail car 102 may be surface 124 of the flat car 109. That is, the vertical column posts 117 may be attached directly to a flat car (or other type of car) to form a rail car. However, in the illustrated embodiment, a bottom of the floor 118 is attached to the surface 124 of the car 109 for transporting along rails 103. Any number of devices and/or methods may be used to attach the body 112 or structure 113 to car 109. In an embodiment, the body 112 is attached to at least surface 124 of car 109 via welds or rivets, or a combination thereof, or other connection devices configured for securing the body 112 to car 109. Also, it is noted that the body 112 or structure 113 need not be permanently attached to the car 109. For example, in an embodiment, the body 112 is configured to be removably attached to car 109 such that it may be interchanged with existing freight car equipment.

In addition to the first deck or floor 118, the rail car 110 additionally comprises an adjustable deck 128 (also referred to as a "C deck") and a removable intermediate deck 134 (also referred to as a "B deck"). The adjustable deck 128 comprises a longitudinally extending surface 115C flanked by two lateral sides 132C. The adjustable deck 128 may comprise a single extending piece or two or more pieces that are assembled together to form the longitudinally extending surface 115C. The adjustable deck 128 is designed with a strength consideration to support loading weights. In particular, the adjustable deck 128 is adjustably mounted within the rail car body 112 for supporting a second series of vehicles in end to end relation longitudinally within the rail car body 112.

The rail car 110 comprises adjustable supports 130 or locking mechanisms for vertically adjusting a position of the adjustable deck within the rail car body 112. For example, the adjustable deck 128 is vertically movable between at least a higher, first position and a lower, second position spaced above the floor 118 and below the roof 114 (e.g., see arrow B in FIG. 2). Adjustable supports 130 secure or lock adjustable deck 128 in a vertical position with respect to vertical column posts 117 and act as a deck reinforcement device. Adjustable supports 130 may be connected at a first end to lateral sides 132C of the deck 128 and at a second end to vertical column posts 117. For example, in an embodiment, adjustable supports 130 comprise a knee brace assembly configured and arranged to attach (e.g., via bolts or rivets) to vertical column posts 117. In an embodiment, knee brace assembly 130 may comprise angled structural members 131 and a bolting plate 133 (also shown in FIG. 11). In an embodiment, post connection plates 135, shown in the detailed perspective view of FIG. 6, may be provided on vertical column posts 117 in predetermined vertical locations so as to allow for guidance when moving and securing adjustable deck 128 in a vertical position using adjustable supports 130. For example, openings or holes in bolting plate 133 may be aligned with openings or holes in post connection plates 135, and bolts/rivets may be placed through the aligned holes and used with nuts to secure adjustable deck 128 in position. It should be noted, however, that predetermined locations for securing adjustable deck 128 need not be provided, and that vertical column posts 117 may be configured such that adjustable deck 128 may be unsecured and repositioned in any number of locations.

The removable intermediate deck 134 comprises a longitudinally extending surface 115B flanked by two lateral sides 132B. Like adjustable deck 128, removable intermediate deck 134 may comprise a single extending piece or two or more pieces that are assembled together to form the longitudinally extending surface 115C. Removable intermediate deck 134 is configured to support a third series of vehicles 200 in end to end relation longitudinally within the rail car body 112. Removable intermediate deck 134 may be removed entirely from the rail car body 102. That is, removable intermediate deck 134 is configured for movement longitudinally into and out of the rail car body 112 for installation and removal of the removable intermediate deck 134 with respect to the rail car body 112 (e.g., see arrow A in FIG. 2). The removability of the removable intermediate deck 134 enables the rail car 110 to be used in (a) a two tier configuration with the removable intermediate deck 134 removed and the adjustable deck 128 in a lower second position for transporting the first and second series of vehicles and (b) a three tier configuration with the removable intermediate deck 134 in the rail car body 112 and the adjustable deck 128 in a higher first position for transporting the first, second, and third series of vehicles. Further description regarding the movement of deck 134 is described with respect to FIGS. 9 and 10, for example.

Also like adjustable deck 128, removable intermediate deck 134 may comprise adjustable supports 130 or locking mechanisms adjacent or on opposing lateral sides 132B of the intermediate deck 134 for securing a position of the intermediate deck 134 within the rail car body 112 when the rail car 110 is used in the three tier configuration. For example, as shown and described with reference to FIG. 4, intermediate deck 134 may be secured at a vertical position (e.g., in the lower second position or a third position) along vertical column posts 117. Adjustable supports 130 may be connected at a first end to a lateral sides 132B of the deck 134 and at a second end to vertical column posts 117. Adjustable supports 130 may comprise a knee brace assembly with members 131 and bolting plates 133 configured and arranged to attach (e.g., via bolts or rivets) to vertical column posts 117, such as described above (e.g., see FIG. 11). Post connection plates 135 may be provided on vertical column posts 117 in one or more predetermined vertical location(s) so as to allow for guidance when securing intermediate deck 134 for three-tier configuration in its vertical position. For example, openings or holes in bolting plate 133 may be aligned with openings or holes in post connection plates 135 in a third position, and bolts/rivets may be placed through the aligned holes and used with nuts to secure intermediate deck 134 in the third position. It should be noted, however, that predetermined locations for securing adjustable deck 128 need not be provided.

Again, the lower and/or higher positions for mounting the C deck may be predetermined positions along the vertical column posts 117, or they may be adjustable positions. In an embodiment, the first and second positions for securing or adjusting the adjustable deck 128 and/or removable intermediate deck 134 may be determined in accordance with deck settings established by AAR M-950-99 and M-950-A-99. In an embodiment, as depicted in FIG. 4, the rail car body 112 may comprise an overall height H of approximately 19 feet, 0 inches ATR. ATR is defined as "At Top of Rail," and may be used as the starting reference point or plane, i.e., measured from a top of rail or track 103. Alternatively, in an embodiment, the rail car body 112 may comprise an overall height H including or between approximately 18 feet and approximately 20 feet. In an embodiment, overall height H may be measured from a top of car 109, i.e., from surface 124 to top of body 112.

The intermediate deck 134 may be positioned in the rail car body 112 at a height H1 (or clearance) above the floor 118. The adjustable deck 128 may be positioned in the rail car body 112 at a height H2 (or clearance) above the intermediate deck 134 and a height H3 (or clearance) below the roof 114. The heights are positioned such that a first, a second, and a third series of vehicles 200 may be arranged in an end to end relationship on the deck surfaces 115A, 115B, and 115C of the deck structures 118, 134, and 128. In an embodiment, the heights H1, H2, and H3 may be substantially equal. For example, if the positions of the adjustable deck 128 and intermediate deck 134 are predetermined, the decks 128 and 134 may be secured in the higher and lower positions to receive vehicles. In an embodiment, the deck heights may be determined based on AAR requirements. For example, in an embodiment, H1 may be approximately 62⅜"; H2 may be approximately 62⅜"; and H3 may be approximately 64 ⅞".

In another embodiment, if the positions of the decks 128 and 134 are variable, the heights H1, H2, and H3 may also be varied and different. For example, larger vehicles such as trucks or SUVs may be positioned on the floor 118 while compact cars are positioned on adjustable deck 134. Thus, the height H1 may be determined to be higher than height H3. Thus, the removable intermediate deck 134 may be positioned according to a desired height.

FIGS. 5, 6, 7, and 8 illustrate a perspective view, a detailed perspective view, a side view, and an end view, respectively, of the rail car 110 for transporting vehicles 200 in a bi-level or two tier configuration. The removable intermediate deck 134 as shown in FIGS. 2-4 has been removed, and the adjustable deck 128 is repositioned to a lower, second position (e.g., as a B deck), and reconnected or secured by its adjustable supports 130 on at least the vertical column posts 117. The floor 118 and adjustable deck 128 are configured to receive a first and second series of vehicles longitudinally on their surfaces 115A and 115C so that they may be transported via train 100.

The adjustable deck 128 may be positioned in the rail car body 112 at a height H4 (or clearance) above the floor 118 and a height H5 (or clearance) below the roof 114. The heights are positioned such that a first and a second series of vehicles may be arranged in an end to end relationship on the deck surfaces 115A and 115C of the deck structures 118 and 128. In an embodiment, the heights H4 and H5 may be substantially equal to each other. For example, if the position of the adjustable deck 128 is predetermined, the deck 128 in a lower second position (as compared to a higher, first position when in a three tier configuration) to receive vehicles. In an embodiment, the deck height may be determined based on AAR requirements. For example, in an embodiment, H4 may be approximately equal to or exceeding 87½", and H5 may be approximately equal to or exceeding 93¼".

A number of devices and/or methods may be used to remove intermediate deck 134 from the rail car body 112. In an embodiment, the removable intermediate deck 134 is removably mounted on support wheels 154 for rolling the removable intermediate deck 134 longitudinally into and out of the rail car body 112. For example, as noted above, the surfaces 115 of the decks may include a number of guides thereon. In an embodiment, the floor 118 comprises rail tracks 156 on its surface 115A (e.g., see FIGS. 9 and 10). The rail tracks 156 may guide the support wheels 154 during movement of the intermediate deck 134 with respect to the rail car body 112. In an embodiment, rail tracks 156 on a floor or a bottom deck structure may be also be tire guides 148 and serve as vehicle tire or wheel guides when loading vehicles therein. Thus, rails tracks 156 or tire guides 148 may serve dual functions.

Figure 9:
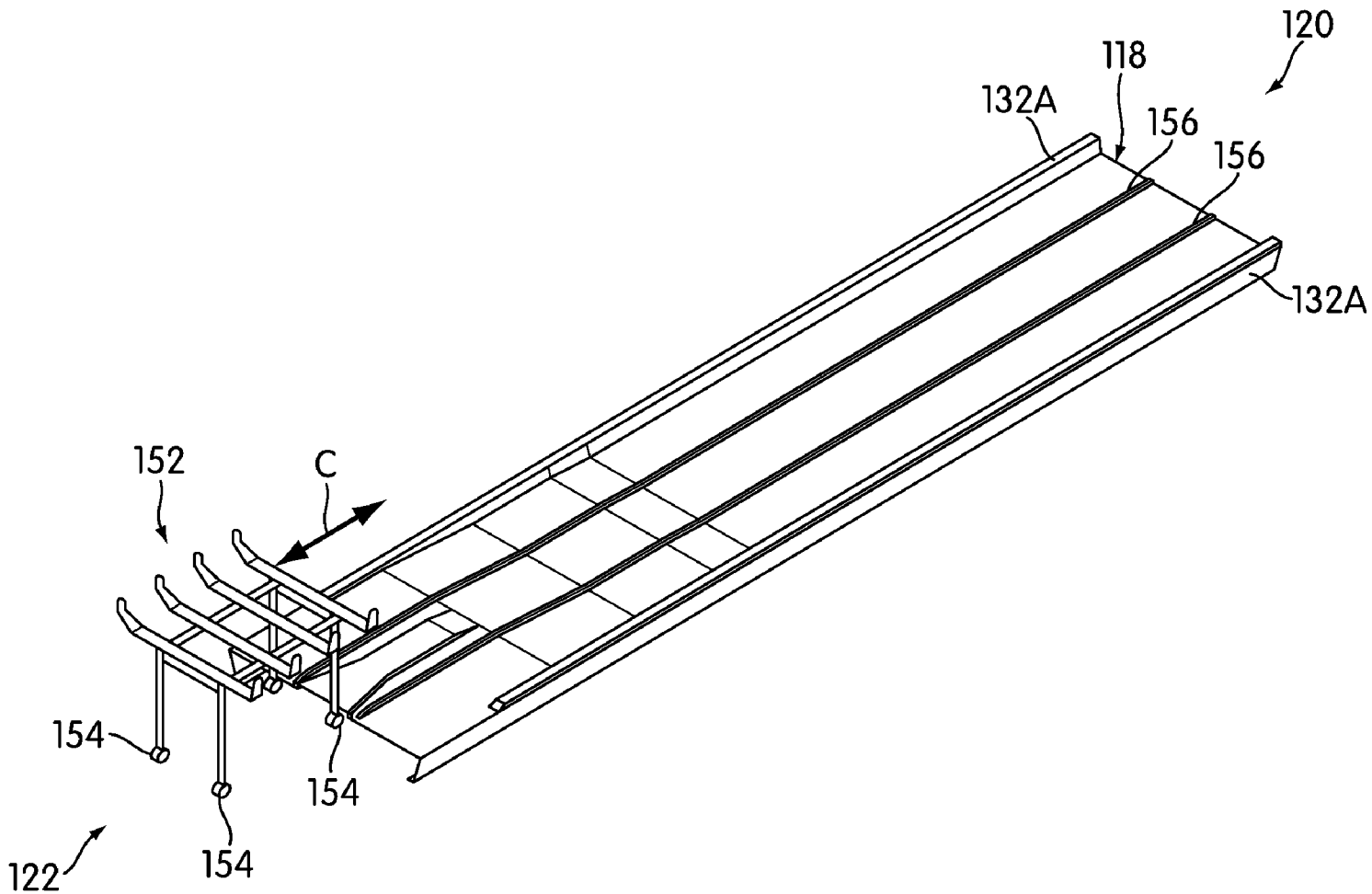
FIGS. 9-10 illustrate an extraction cart and a method of using the extraction cart to roll a removable intermediate deck from (or into) a rail car body.
Figure 10:
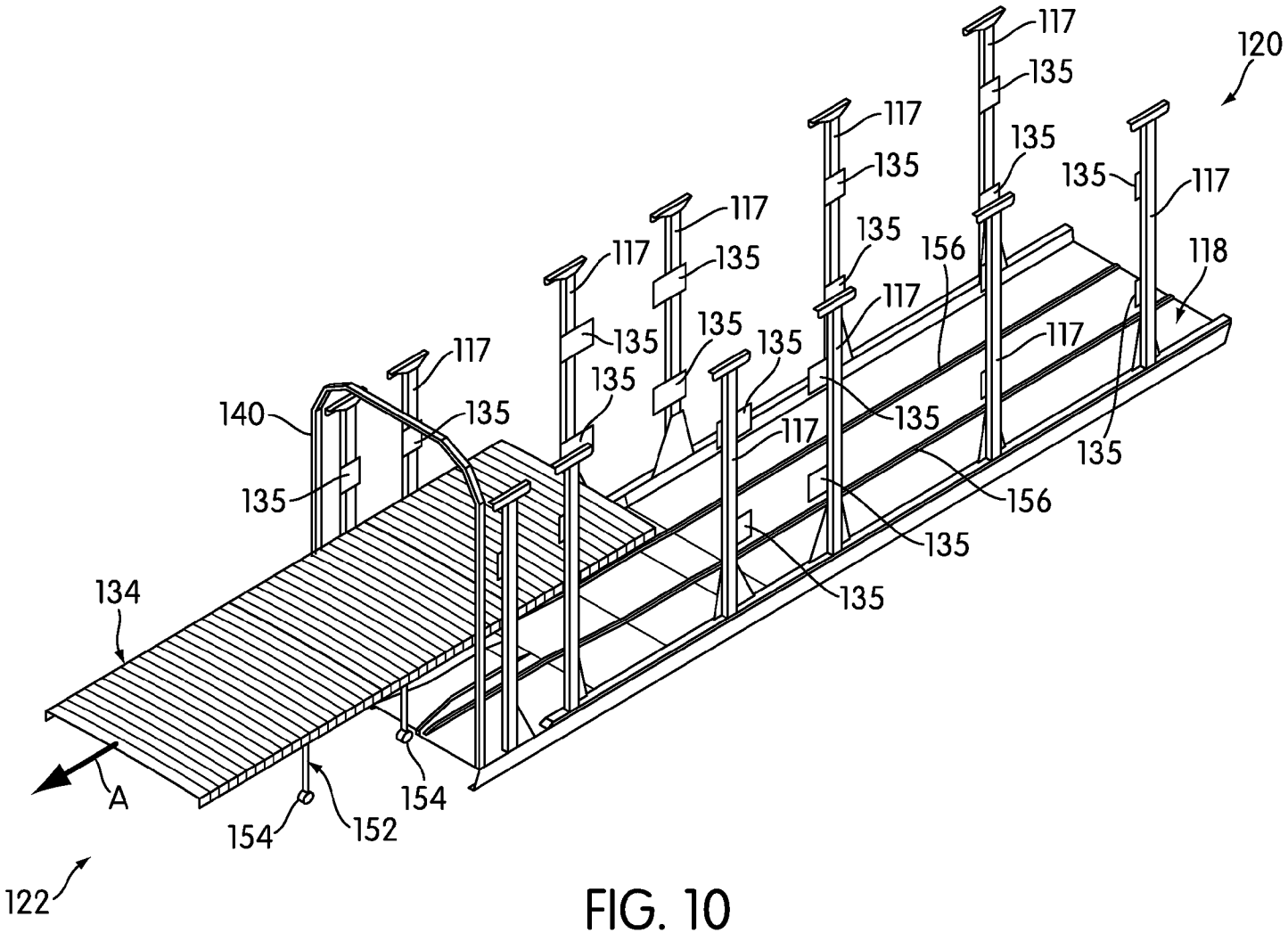

In an embodiment, the support wheels 154 are provided on an extraction cart 152. The extraction cart 152 is configured to assist in the rolling of the intermediate deck 134 into and out of the rail car body 112 (e.g., see arrow C). FIGS. 9 and 10 illustrate extraction cart 152 and its method of use for removing the removable intermediate deck 134. Body 112 and a number of parts/structures been removed for illustrative purposes only. The wheels 154 of the extraction cart 152 are guided by the rail tracks 156 into the interior of multi-level structure 113 (e.g., towards second end 122), and into a position to receive the intermediate deck 134. The wheels 154 may ride alongside a side of the tracks 156 (e.g., on an exterior side of each track) or within a portion of each track. The extraction cart 152 may comprise one or more supports (as shown) or a supportive surface for receiving the intermediate deck 134.

To convert the body 112 from a tri-level structure to a bi-level structure, the process may be generally described as follows: Vehicles are removed from the interior of the structure 113 or body 112. The extraction cart 152 is rolled (guided via rail tracks 156 on floor 118) into the interior. The intermediate deck 134 is unsecured (e.g., supports 130 are unlocked) and lowered onto the extraction cart 152 (e.g., by means of use of an overhead crane or use of forklift trucks or manual labor). The extraction cart 152 is then guided out of the interior of the structure 113 and car body 112, carrying the intermediate deck 134 thereon, in a horizontal direction such as indicated by arrow A in FIG. 10. Once clear of the rack structure 113, the intermediate deck 134 can be removed from (e.g., picked up off of) the extraction cart 152, and moved to a storage area for safe keeping.

Thereafter, the adjustable deck 128 may be moved (i.e., lowered), as represented by arrow B in FIG. 4, in a vertical downward direction from its higher first position to a lower second position within rail car body 112, for example, to form a bi-level device as shown in FIG. 8. The lowering of the adjustable deck 128 may be performed by using an overhead crane or forklift trucks and/or manpower. The adjustable deck 128 is secured (e.g., via adjustable supports 130) in a lower, second position (see FIGS. 5-8). The three tier structure now becomes and may perform the loading requirements of a two tier structure.

Of course, it is to be understood that similar yet opposite steps may be used for inserting removable intermediate deck 134 (to convert from a bi-level structure to a tri-level structure as shown in FIGS. 2-4). For example, adjustable deck 128 may be moved in a vertical upward direction (opposite arrow B in FIG. 4) from lower second position to higher first position and secured (e.g., using adjustable supports 130) to vertical column posts 117 (e.g., at post connection plates 155). After adjustable deck 128 is secured in a higher position, intermediate deck 134 may be mounted on extraction cart 152. Extraction cart 152 may be used to insert or slide intermediate deck 134 into structure 113 of body 112, using rail tracks 156 as a guide for movement thereinto (in an opposite horizontal direction as shown by arrow A in FIG. 10). Thereafter, intermediate deck 134 may be lifted or removed from extraction cart 152, and positioned along vertical column posts 117 (e.g., in a third position) at an appropriate height and secured to posts 117 using adjustable supports 130, etc., for example.

As disclosed herein, the rail car design is built to be a three tier configuration that can be changed over to a two tier configuration. Such a process may be performed in a train or rail yard by a number of workers and/or machinery. For example, the process for converting the rail car 110 from the three tier configuration shown in FIGS. 2-4 to the two tier configuration shown in FIGS. 5-8 reduces a typical man-hour conversion process, such that it is more efficient, requires less time, and is more cost effective.

Figure 11:
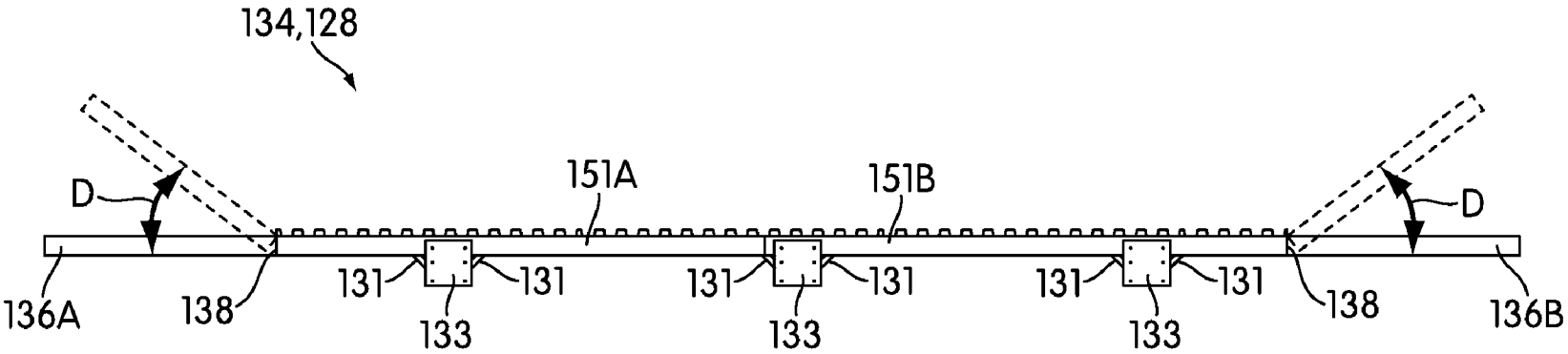
FIG. 11 illustrates an exemplary embodiment of an intermediate deck formed from several elements in accordance with an embodiment.

As previously noted, in an embodiment, the intermediate deck 134 and/or adjustable deck 128 may be manufactured to comprise several pieces that are assembled and secured together to form a longitudinally extending surface 115B or 115C. FIG. 11 illustrates as example of structures formed from several assemblies that may be used for intermediate deck 134 and/or adjustable deck 128. In an embodiment, the longitudinally extending surface(s) 115B and/or 115C may comprise a central or middle assembly and end assemblies attached thereto. For example, in the illustrated embodiment of FIG. 11, the surface has a middle assembly formed from two sheets 151A and 151B or corrugated decks. First ends of the sheets 151A and 151B are attached to each other to form a horizontal middle assembly. At second ends of sheets 151A and 151B may be attached additional end deck portions 136A and 136B.

In an embodiment, end deck portions 136A and 136B may be hinged deck portions attached to second ends of sheets 151A and 151B via hinges 138. Thus, in an embodiment, the intermediate deck 134 or adjustable deck 128 may comprise a longitudinally extending surface 115B or 115C with a first hinged deck portion 136A at one end, a second hinged deck portion 136B at another end, and two middle assemblies 151A and 151B therebetween. Hinged deck portions 136A and/or 136B may be moved from a horizontal position longitudinally in line with middle assemblies 151A/151B to an angled position (e.g., at an angle with respect to a longitudinal line of the decks). Arrows D indicate the pivotal movement between the horizontal and angled positions that each or either deck portion 136A and/or 136B may make with respect to the middle assembly(ies). As previously described, the hinged deck portions 136A and/or 136B may be configured to pivot and lock in a position for clearance such that vehicles may be inserted into body 112.

FIG. 2 illustrates the use of a hinged deck portion 136 at each end of the longitudinally extending surface 115B of intermediate deck 134, adjacent either end 120 and 122 of the rail car body 112. FIGS. 3 and 4 show the hinged deck portion 136 adjacent end 122 in an up or an angled position. Hinged deck portion(s) 136 allow for additional vertical height clearance when loading or unloading vehicles to be transported in rail car 110. Hinged deck portion(s) 136 may be pivoted at an angle upwardly such that there is provided a clearance in accordance with a minimum vertical clear height (e.g., approximately 62 inches or more). For example, car 110 may have entry ramps (not shown) adjacent or on floor 118, which start at a height of approximately 8 to 11 inches. Hinged deck portion(s) provide the required minimum vertical clearance when moving vehicles into body 112 on floor 118. In an embodiment, hinged deck portion(s) are configured to be raised such that an end of the deck is approximately 10 to approximately 12 inches from its original position. In another embodiment, the hinged deck portion 136 is raised approximately 11½ inches. Hinged deck portion(s) may be secured in a lowered or an angled position in any number of ways, including, but not limited to, using locking pin(s) and receiver bracket(s) (not shown). For example, locking pins and brackets may be provided on lateral sides (132B, 132C) of the hinged deck portion 136 and adjacent areas on body 112 (e.g., on a column or post of body 112). The locking pins and brackets may be attached to either of hinged deck portion 136 or the body 112, and, in an embodiment, may be constructed to move with hinged deck portion 136. However, such devices are not meant to be limiting.

Figure 7:
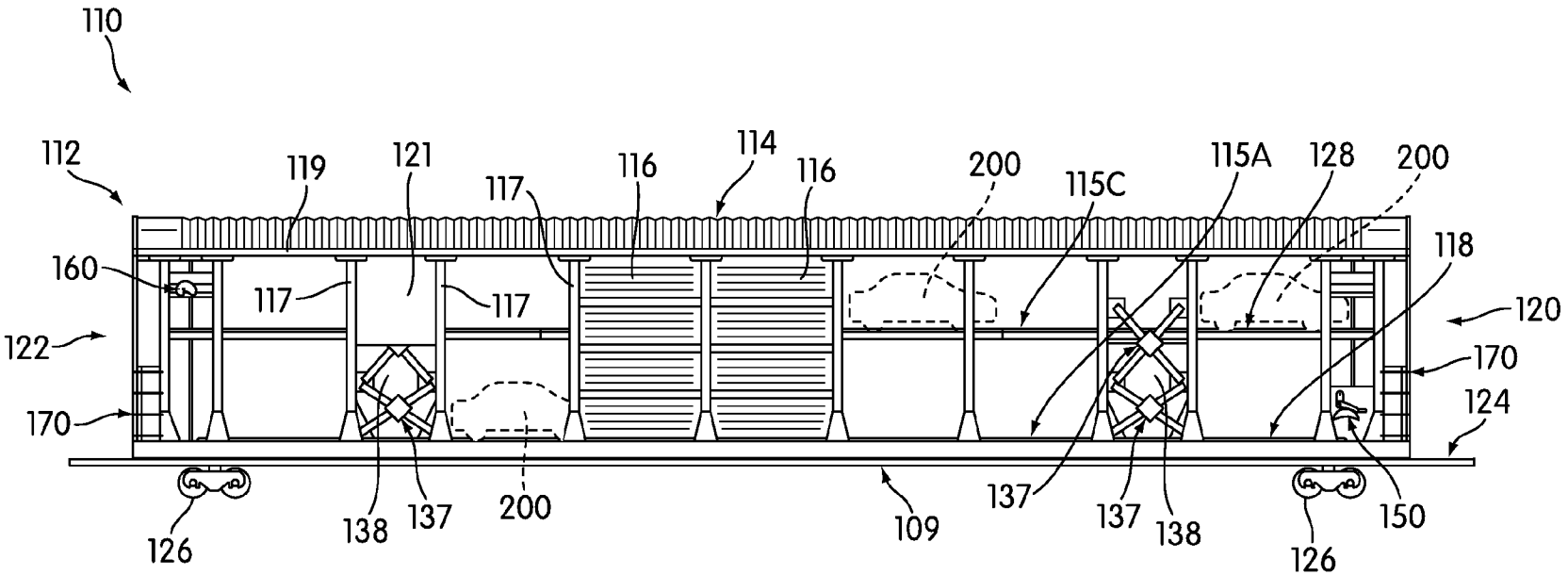

In order to pivot a hinged deck portion 136 upwardly as described, rail car body may comprise a sheer and eccentric pulley system 160, generally depicted in FIGS. 3 and 7. The pulley system 160 assists in the lifting of a moveable hinge deck portion 136 upwardly or downwardly and may use spring tension to perform such tasks. The pulley system 160 may be within the interior or on the exterior of the body 112 and may be partially or entirely detachable or removable from the structure 113. For example, the pulley system 160 may be removed from the structure 113 after its tasks are performed. It need not remain on the structure 113 when in either mode (tri- or bi-level) or when transporting vehicles. Although only a single pulley system 160 is shown at second end 122 of body 112, this is for illustrative purposes only, and it is to be understood that a second pulley system 160 may also be provided at first end 120 (such as when there are two hinged deck portions at either side), or that only a single pulley system 160 may be provided on first end 120. In some embodiments, the pulley system 160 need not be provided. For example, when the structure 113 is in bi-level, further clearance by pivoting movable hinge deck portion 136 may not be needed. Generally, such pulley systems 160 are known in the art and therefore are not described in detail herein.

Using several assemblies that are secured together to form the longitudinal extending surface(s) 115B and/or 115C can ease the removal and/or insertion of the respective deck during transition between the tri- and bi-levels. For example, when removing an intermediate deck 134 with two hinged deck portions 136 and two middle assemblies, a first hinge deck portion 136 may be removed (unsecuring hinge 138 and adjustable supports 130) and extracted from the rail car body 112 (via extraction cart 152). In a similar manner, this may be followed by a first assembly piece, a second assembly piece, and then the final hinged portion 136. The decks 134 and 128 may be removed from the interior of the structure 113 or placed into and mounted into the interior of the structure 113 in a similar manner (piece-by-piece).

Figure 6:
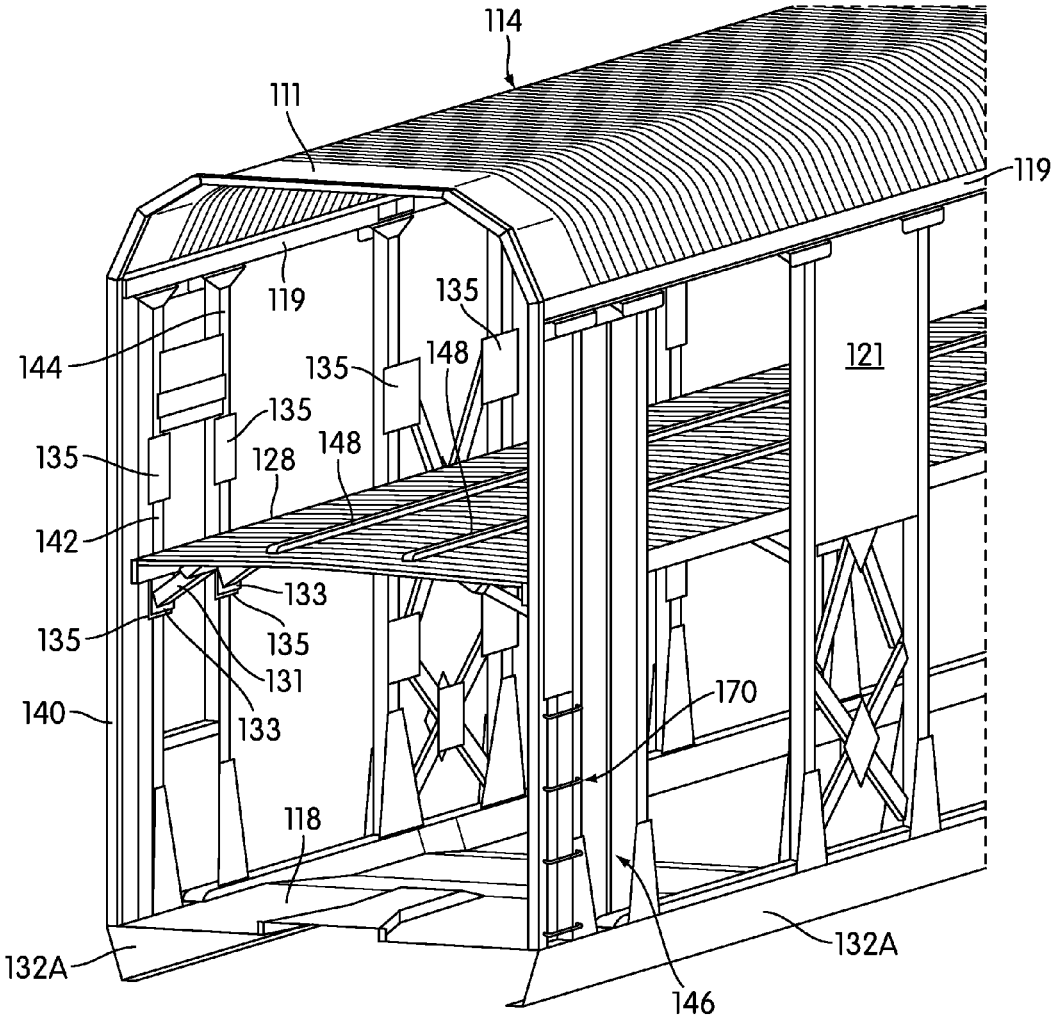

The rail car body 112 may include end door framing structures 140 at one or both ends 120 and 122 that assist in enabling the removable intermediate deck 134 to be withdrawn from the interior of the rail car body 112. FIG. 6 illustrates a detailed end perspective view of the rail car in accordance with an embodiment. The design and construction of the end door framing structures 140 on the first and second (left and right) sides are designed at a wider distance from each other than those of the intermediate vertical column posts 117. This wider configuration provides clearance for the intermediate deck 134 extraction and insertion when the rail car 110 is converted between the three tier configuration and the two tier configuration, or vice versa.

The end door framing structures 140 includes a first column post 142 and a second column post 144. The first and second column posts 142, 144 may be secured to longitudinal supports 119 and/or lateral supports by roof 114 and floor 118 of structure 113 using devices and methods such as, but not limited to, end caps, connection plates, braces, bolts, and welding. Shear bay panels 146 are connected to the posts 142 and 144. The posts 142 and 144 and columns are used to form the multi-level structure 113 and to support the decks, shear bay panels 146, and other items used in rail car 110 (e.g., adjustable supports, locking devices, etc.). Also shown in FIG. 6 is the relationship between the end door framing structure 140 to end canopy 111 and to the connection to roof sheet panels 114, as well as the relationship between the roof sheet panels 114 and to the top longitudinal support members 119. The end canopy 111 provides a connection point and transitional area between the roof 114 and the structures 113 and 140. The design and construction of the end door framing structure 140, end canopy 111, shear bay panels 146 are exemplary only and not meant to be limiting.

In an embodiment, the end door framing structure 140 is designed to meet or exceed all requirements of AAR Specification M-941, "End Enclosure for Fully Enclosed Multi-Level Auto Rack Cars." In an embodiment, the end structure 140 is capable of withstanding, without failure or permanent deformation, a static load of 1000 Lbs. In another embodiment, the end structure 140 is designed to withstand high speed impacts test up to 10 mph, with no failures.

The end door framing structure 140 is designed separately from the deck components 118, 128, and 134 and structure 113. This allows for the flexibility of making the intermediate deck 134 moveable to a bi-level setting, and for deck 134 to be extracted and saved for future re-application (if it is desired to convert back to a tri-level mode).

Although not shown in the Figures, it is to be understood that one or more doors may be attached to the end door framing structure 140. The doors are not shown for clarification and explanatory purposes only. However, it is to be understood that doors have zero openings and prevent access to contents (vehicles) in the interior of the rail car body 112 when they are closed and locked. The doors also may provide a surface area of sufficient size and density to prevent unauthorized entry into a rail car. In an embodiment, two doors are hingedly mounted to both first and second sides (left and right) and at least one end 120 or 122 of the rail car body 112. Such features are generally known in the art and therefore are not described in detail herein. The end doors that are used may be pre-fabricated doors or doors that have been designed or re-designed to connect to the rail car body 112. For example, TTX Company provides doors that may be modified for the rail car body 112 as disclosed herein. Examples of framing structures 140 and/or doors that may be used or modified for use with the herein disclosed structure 113 and/or body 112 include features disclosed in U.S. Pat. No. 7,401,559 and/or U.S. Patent Application Publication 2008/0276830 A1, assigned to TTX Company, both of which are hereby incorporated by reference in their entirety.

The design of the car body 112 and structure 113 as disclosed herein may be formed based on the foundation of AAR Specifications M-950 and M-950-A. It may be designed such that it is usable with a flat car of 90' in length. However, it is to be understood that the dimensions noted herein (lengths, heights, widths, etc.) are not meant to be limiting and may be altered or changed according to needs of a railroad company or supplier.

This disclosure provides a universal multi-level structure/configuration that is capable of being transported by trains. The conversion is performed by removing intermediate deck 134 from the interior of the structure 113. Removal of deck 134 removes weight from the rail car 110 or structure 113. It also allows for vertical re-configuration of the adjustable deck 128 in at least one second position. Insertion of the intermediate deck 134 within the rail car 110 provides multiple levels for transport and prevents unneeded costs due to storage of rail cars and/or unused bi-level rail car configurations.

Also, the design of the rail car body 112 enables the structure 113 to be attached or mounted to any number of types of cars 109 (e.g., flat cars, well cars) or containers. Thus, the body 112 and/or structure 113 are capable of being interchanged with existing freight car equipment (e.g., using crane or lift equipment in a rail car shop or maintenance facility).

Additionally, the herein disclosed design is not restricted or limited by the exits or entries into the interior of the rail car 110. The end features (e.g., canopy 111 and panel doors) of the disclosed body 112 or structure 113 is wider, and thus, the extraction of the B-deck structure can be undertaken without the destruction of the deck structure. Also, in an embodiment, door hinges may be mounted externally so as to provide some additional clearance when opening the doors for removal or installation of the intermediate deck 134.

The herein described structure 113 and body 112 provides a single unit that may be converted between two and three levels for transporting objects. A user does not need to buy and store both two deck and three deck designs. When removed, the intermediate deck 134 can be stored so that the body 112 may be used in bi-level mode. Storage space required for deck 134 is minimal; thus, a user need not worry about an amount of space needed to store a full car or structure. The requirement for less space may be cost effective, particularly when multiple units need to be stored, because it can reduce or eliminate a need for renting larger spaces for storage. Besides requiring less space for storage, the convertibility of body 112 and structure 113 is also cost effective. Intermediate deck 134 can later be remounted to structure 113 when the need arises to having tri-level mode service demand requirements.

Other features of the illustrated embodiments are also not meant to be limiting. For example, although throughout the disclosure the intermediate deck 134 is referred to as removable from an interior of the rail car body 112, it is to be understood that, in an embodiment, the C deck or adjustable deck 128 may be a removable deck, and the intermediate deck 134 (B deck) may be a vertically adjustable deck. Also, if it is determined that the removable intermediate deck 134 is not needed or no longer required, the deck structure can be removed out of the rack structure interior and recycled (e.g., as scrap metal or for other uses).

The materials used in the herein disclosed rail car 110 and its body 112 should not be limiting. As an example, in an embodiment, the rail car body 112 is built with materials to be of a type providing strength, ease of repairs and/or replacement, and resistant to deterioration due to weather, environment, and heavy uses. For example, materials having elements of improved atmospheric corrosion resistance properties may be incorporated, such as steel materials. In an embodiment, some of the rail car body 112 components may be galvanized coated or plated to Grade G-235 thickness, nominal coating thickness of 2 mils, or greater (reference ASTM Specification A-653). For example, items that may receive the galvanized coating may include, but are not limited to, the roof assembly 114, top chord members, side screen panels of the side walls 116, and connecting anti-barrier panels. In an embodiment, in other areas, surfaces may have waterborne paint coatings and/or powder coatings having, for example, a life expectancy of 15 to 20 years of protection (against weather and/or environmental elements).

In another embodiment, side panels 116 need not be provided. In one embodiment, the structure 113 may be provided and/or retrofit within an existing rail car. For example, as illustratively shown in FIG. 10, some or all of the parts of the disclosed structure 113 may be mounted within a car body and provide a similar convertible structure as described herein.

Also it is to be understood that not all of the discussed features may have been shown in each of the corresponding Figures. Some features may have been removed and/or only shown in one or more Figures for simplicity and/or illustrative purposes.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A rail car for transporting vehicles comprising:

a rail car body having a roof, side walls, and a floor for supporting a first series of vehicles in end to end relation longitudinally within the rail car body;

track engaging wheels for rollingly supporting the rail car body on a pair of rail tracks;

an adjustable deck adjustably mounted within the rail car body for supporting a second series of vehicles in end to end relation longitudinally within the rail car body;

adjustable supports on opposing lateral sides of the adjustable deck for vertically adjusting a position of the adjustable deck within the rail car body, the adjustable deck being vertically movable by the adjustable supports between at least a higher, first position and a lower second position each spaced above the floor and below the roof;

a removable intermediate deck for supporting a third series of vehicles in end to end relation longitudinally within the rail car body, the removable intermediate deck configured for movement longitudinally into and out of the rail car body independently of the adjustable deck for installation and removal of the removable intermediate deck with respect to the rail car body while the adjustable deck remains in the rail car body in the position adjusted by the adjustable supports;

wherein removability of the removable intermediate deck enables the rail car to be used in (a) a two tier configuration with the removable intermediate deck removed and the adjustable deck in the lower second position for transporting the first and second series of vehicles and (b) a three tier configuration with the removable intermediate deck in the rail car body and the adjustable deck in the higher first position for transporting the first, second, and third series of vehicles.

2. The rail car according to claim 1, further comprising a flat car having a surface for receiving and attaching to the rail car body thereto, and wherein the track engaging wheels are provided on the flat car.

3. The rail car according to claim 1, wherein the removable intermediate deck comprises at least one hinged deck portion configured to pivot with respect to its longitudinally extending surface between a horizontal position and an angled position.

4. The rail car according to claim 3, further comprising adjustable supports configured to secure the at least one hinged deck portion in the angled position.

5. The rail car according to claim 1, wherein the removable intermediate deck comprises locking mechanisms on opposing lateral sides of the intermediate deck for securing a position of the intermediate deck within the rail car body when the rail car is used in the three tier configuration.

6. The rail car according to claim 5, wherein the intermediate deck is secured in the lower second position.

7. A train comprising:

a locomotive comprising a body and track engaging wheels, and at least one rail car for transporting vehicles comprising:

a rail car body having a roof, side walls, and a floor for supporting a first series of vehicles in end to end relation longitudinally within the rail car body;

track engaging wheels for rollingly supporting the rail car body on a pair of rail tracks;

an adjustable deck adjustably mounted within the rail car body for supporting a second series of vehicles in end to end relation longitudinally within the rail car body;

adjustable supports on opposing lateral sides of the adjustable deck for vertically adjusting a position of the adjustable deck within the rail car body, the adjustable deck being vertically movable by the adjustable supports between at least a higher, first position and a lower second position each spaced above the floor and below the roof;

a removable intermediate deck for supporting a third series of vehicles in end to end relation longitudinally within the rail car body, the removable intermediate deck configured for movement longitudinally into and out of the rail car body independently of the adjustable deck for installation and removal of the removable intermediate deck with respect to the rail car body while the adjustable deck remains in the rail car body in the position adjusted by the adjustable supports;

wherein removability of the removable intermediate deck enables the rail car to be used in (a) a two tier configuration with the removable intermediate deck removed and the adjustable deck in the lower second position for transporting the first and second series of vehicles and (b) a three tier configuration with the removable intermediate deck in the rail car body and the adjustable deck in the higher first position for transporting the first, second, and third series of vehicles.

8. A combination comprising: a rail car for transporting vehicles and an extraction cart, the rail car comprising:

a rail car body having a roof, side walls, and a floor for supporting a first series of vehicles in end to end relation longitudinally within the rail car body;

track engaging wheels for rollingly supporting the rail car body on a pair of rail tracks;

an adjustable deck adjustably mounted within the rail car body for supporting a second series of vehicles in end to end relation longitudinally within the rail car body;

adjustable supports on opposing lateral sides of the adjustable deck for vertically adjusting a position of the adjustable deck within the rail car body, the adjustable deck being vertically movable by the adjustable supports between at least a higher, first position and a lower second position each spaced above the floor and below the roof;

a removable intermediate deck for supporting a third series of vehicles in end to end relation longitudinally within the rail car body, the removable intermediate deck configured for movement longitudinally into and out of the rail car body for installation and removal of the removable intermediate deck with respect to the rail car body;

wherein removability of the removable intermediate deck enables the rail car to be used in (a) a two tier configuration with the removable intermediate deck removed and the adjustable deck in the lower second position for transporting the first and second series of vehicles and (b) a three tier configuration with the removable intermediate deck in the rail car body and the adjustable deck in the higher first position for transporting the first, second, and third series of vehicles, and the extraction cart having wheels for rolling the removable intermediate deck longitudinally into and out of the rail car body, the extraction cart configured to assist in the installation and removability of the intermediate deck into and out of the rail car body.

9. The rail car in combination with the extraction cart according to claim 8, wherein the floor of the rail car comprises a plurality of tracks extending longitudinally within the rail car body for guiding the wheels of the extraction cart.

10. A combination comprising a removable deck and an extraction cart, the removable deck for supporting a third series of vehicles in end to end relation longitudinally within a rail car body, the rail car body having a roof, side walls, and a floor for supporting a first series of vehicles in end to end relation longitudinally within the rail car body, and an adjustable deck adjustably mounted via adjustable supports within the rail car body for supporting a second series of vehicles in end to end relation longitudinally within the rail car body, the adjustable deck being vertically movable and secured by the adjustable supports between at least two positions within the rail car body;

the removable deck comprising:

a longitudinally extending structure with a surface for supporting the first series of vehicles; and locking mechanisms on opposing lateral sides of the structure for securing a position of the structure within the rail car body, the position being spaced above the floor and below the roof of the rail car body, wherein securement of the removable deck in the rail car body enables transportation of the third series of vehicles with the rail car body, the removable intermediate deck configured for movement longitudinally into and out of the rail car body independently of the adjustable deck for installation and removal of the removable intermediate deck with respect to the rail car body while the adjustable deck remains mounted in the rail car body in; and the extraction cart comprising:

support wheels and configured to assist in rolling the longitudinally extending structure of the removable deck longitudinally into and out of the rail car body.

11. The combination according to claim 10, wherein the removable deck further comprises at least one hinged deck portion configured to pivot with respect to the longitudinally extending structure between a horizontal position and an angled position.

12. The combination according to claim 11, wherein the removable deck further comprises adjustable supports configured to secure the at least one hinged deck portion in the angled position.

13. A method for converting a rail car body from a three tier configuration for transporting a first, a second, and a third series of vehicles in end to end relation longitudinally within the rail car body to a two tier configuration for transporting the first and the second series of vehicles in end to end relation longitudinally within the rail car body, the rail car body having a roof, side walls, and a floor for supporting a first series of vehicles in end to end relation longitudinally within the rail car body; an adjustable deck adjustably mounted within the rail car body for supporting a second series of vehicles in end to end relation longitudinally within the rail car body; adjustable supports on opposing lateral sides of the adjustable deck for vertically adjusting a position of the adjustable deck within the rail car body between at least a higher, first position and a lower second position each spaced above the floor and below the roof; a removable intermediate deck for supporting a third series of vehicles in end to end relation longitudinally within the rail car body, the removable intermediate deck configured for movement longitudinally into and out of the rail car body for installation and removal of the removable intermediate deck with respect to the rail car body; and the method comprising:

removing the intermediate deck out of the rail car body in a longitudinal direction from the rail car body independently of the adjustable deck and while the adjustable deck remains in the rail car body in the position adjusted by the adjustable supports; and adjusting the adjustable deck from the higher, first position to the lower, second position using the adjustable supports such that the floor and adjustable deck supports the first and second series of vehicles for transportation.

14. The method according to claim 13, wherein the removing of the removable intermediate deck is assisted by the use of an extraction cart with wheels for rolling the removable intermediate deck longitudinally out of the rail car body.

15. The method according to claim 14, wherein the floor of the rail car body comprises a plurality of tracks extending longitudinally within the rail car body, and wherein the removing of the removable intermediate deck of the method further comprises guiding the wheels of the extraction cart along the plurality of tracks.

16. The method according to claim 13, wherein the removable intermediate deck comprises locking mechanisms on opposing lateral sides thereof for securing a position of the intermediate deck within the rail car body when the rail car is used in the three tier configuration, and wherein the method further comprises: unlocking the locking mechanisms of the removable intermediate deck before the removing of the intermediate deck.

* * * * *